US010582758B1

(12) United States Patent
DeMeo

(10) Patent No.: US 10,582,758 B1
(45) Date of Patent: Mar. 10, 2020

(54) GARMENT EYEGLASS HOLDER

(71) Applicant: Palmer Christopher DeMeo, Woodbridge, VA (US)

(72) Inventor: Palmer Christopher DeMeo, Woodbridge, VA (US)

( * ) Notice: Subject to any disclaimer, the term of this patent is extended or adjusted under 35 U.S.C. 154(b) by 0 days.

(21) Appl. No.: 16/350,235

(22) Filed: Oct. 18, 2018

(51) Int. Cl.
*A45F 5/02* (2006.01)
*A41B 1/00* (2006.01)

(52) U.S. Cl.
CPC *A45F 5/02* (2013.01); *A41B 1/00* (2013.01); *A45F 2200/0541* (2013.01)

(58) Field of Classification Search
CPC .... A45F 5/02; A41B 9/06; A41B 1/00; A41B 1/06; A44B 1/185; A41H 37/005; A41H 37/10
USPC ..... 2/113–115, 244, 265, 266
See application file for complete search history.

(56) References Cited

U.S. PATENT DOCUMENTS 175,821 A 4/1876 Clawson
2,750,595 A * 6/1956 Hollinger ..... A41B 9/06 2/113
4,465,004 A * 8/1984 Wurst ..... D05B 3/24 112/475.25
4,637,075 A * 1/1987 Ingrisano ..... A41D 13/0012 2/102
4,666,564 A * 5/1987 Zeitsch ..... B01D 3/08 159/11.1
4,885,805 A * 12/1989 Mason ..... A41D 27/08 2/244
4,896,377 A * 1/1990 Ferdi ..... A41B 1/08 2/106
5,584,074 A * 12/1996 Battle-Smith ..... A41D 1/04 2/108
5,903,928 A * 5/1999 Hyung-Seob ..... A41D 27/00 2/244
5,956,812 A 9/1999 Moennig
6,339,848 B1 * 1/2002 Mayhood ..... A41F 9/002 2/338
7,496,991 B2 3/2009 Avery
9,192,199 B1 * 11/2015 Lodza ..... A41D 13/0015
2002/0170147 A1 11/2002 Heller
2005/0022290 A1 2/2005 Neaman
2007/0083970 A1 * 4/2007 Turney ..... A41B 13/00 2/69
2008/0127460 A1 6/2008 Severen et al.
2009/0126159 A1 * 5/2009 Murphy, Jr. ..... A45F 5/00 24/3.3
2012/0096628 A1 4/2012 Grady
2013/0025019 A1 1/2013 Jones
2014/0215763 A1 8/2014 White
2015/0047256 A1 * 2/2015 Redler ..... A01G 5/02 47/65.7
2016/0025996 A1 1/2016 Bacon

OTHER PUBLICATIONS

Google search for "button hole is key shaped" Sep. 12, 2019 see center of p. 1.

* cited by examiner

*Primary Examiner* — Gloria M Hale
(74) *Attorney, Agent, or Firm* — Palmer C. DeMeo; Palmer Patent Consultants, LLC

(57) ABSTRACT

An eyeglass holder for the chest portion of a garment which uses a threaded button hole in the chest portion of the garment to support a pair of eyeglasses by inserting one of the temple legs of the eyeglasses into the threaded button hole.

11 Claims, 1 Drawing Sheet

GARMENT EYEGLASS HOLDER

BACKGROUND OF THE INVENTION

1. Field of the Invention

The present invention relates to a means for holding a pair of eyeglasses from a pocket-less garment such as a T-shirt or a polo-shirt.

2. Description of the Related Art

It is often inconvenient to hold a pair of eyeglasses on a person while momentarily or temporarily preoccupied in certain physical activities that require the use of both hands such as lifting, holding or moving certain objects. This presents a dilemma for a person when that person is wearing a garment such as a T-shirt or polo-shirt. It is also inconvenient for a person to hold or secure a pair of eyeglasses on the person while running. It would also be unwise for that person, during these physical activities, to insert his/her eyeglasses in the pockets of a pair of pants or skirt that he or she is wearing without the possibility of damaging the eyeglasses by crushing or bending them. Even the simple expedient of inserting one of the eyeglasses' temple arms over and under the front neck portion of the garment would not safely secure the pair of eyeglasses to the garment especially when the garment's wearer needs to bend over to perform certain physical tasks. So, therefore, inventors have devised a myriad of ways to overcome this dilemma by: attaching various clips or clamps to the front side of the pocket-less garment such as disclosed in U.S. 175,821; U.S. 2016/0025996; U.S. 2008/0127460; and U.S. Pat. No. 5,956,812; by stitching or sewing a fabric strip or loop to the front side of the pocket-less garment such as disclosed in U.S. 2014/0215763; U.S. 2013/0025019; 2005/0022290; and U.S. 2012/0096628 and by utilizing magnetic devices attached to the front side of the pocket-less garment such as disclosed in U.S. Pat. No. 7,496,991; and U.S. 2002/0170147.

SUMMARY OF THE INVENTION

The inventor has devised a simple and inexpensive means to securely hold and suspend a pair of eyeglasses from the front side of a garment especially for a man's T-shirt or polo-shirt for those activities mentioned above. A threaded button hole is stitched to a front upper portion of a person's garment through which button hole one temple leg of the pair of eyeglasses is inserted and pulled downwardly until the connecting portion between the one temple leg and the frame rests on the bottom edge of the button hole. The size of the button hole is made small but large enough to accommodate the insertion of one temple of the pair of eyeglasses and to securely hold them to the garment such as to prevent them from falling down during the physical activities mentioned above.

It is an object of this invention to provide a simple, inexpensive, and expedient means for supporting a pair of eyeglasses on the front side of a garment such as a T-shirt or a polo-shirt, primarily worn by men, to momentarily or temporarily free up the use of a person's hands in order to perform certain activities such as moving or lifting objects with both hands.

It is another object of this invention to provide a holder for a pair of eyeglasses on the front side of a T-shirt or polo-shirt which holder will support the pair of eyeglasses in a generally sturdy and vertical position while performing certain activities that momentarily or temporarily require the use of a person's hands. However, this invention is also applicable for women T-shirts and polo-shirts.

It is a further object of this invention to hold and suspend a pair of eyeglasses from an opening in the front side of a T-shirt or polo-shirt, which opening is a threaded opening similar to a button hole in a garment, from which opening one temple leg of the pair of eyeglasses can be inserted such that it can be securely supported therein when a person is doing physical work that requires some degree of forwardly bending his/her body or when that person is running.

Other objects and advantages of this invention will become more apparent from a reading of the following description of which the attached drawings form a part.

DETAILED DESCRIPTION OF THE PREFERRED EMBODIMENTS

Figure 1:
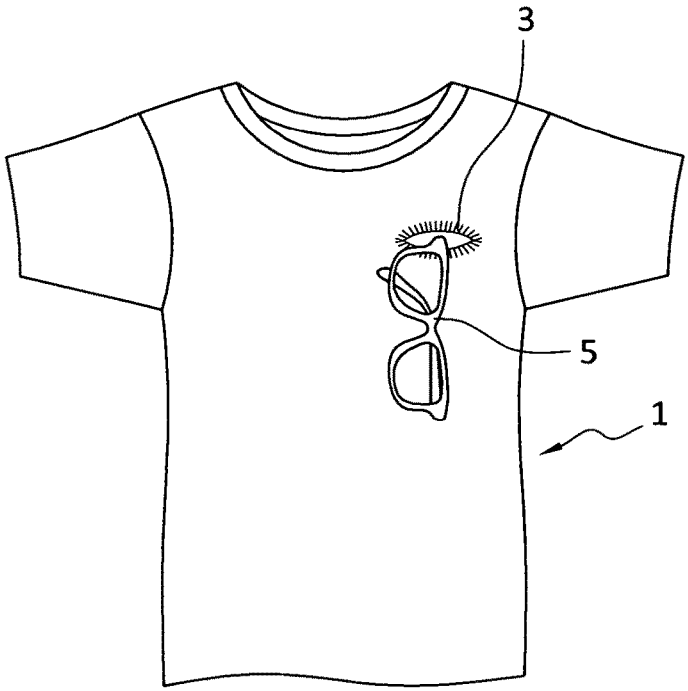
FIG. 1 is a front elevational view of a T-shirt showing a first embodiment of the invention.

In FIG. 1 there is shown a conventional male T-shirt 1 with a treaded button-hole 3 on the left side of the T-shirt 1 at approximately chest high. When the person is about to do strenuous work that requires some bending over his upper body and he wants to retain ready possession of his eyeglasses 5, he simply manually inserts one of the temple legs of his eyeglasses into the threaded button hole 3 all the way down to rest between the connecting portion of the inserted temple leg and the frame of the eyeglasses 5. This embodiment is more suitable for a right-handed person. However, the button hole 3 can also be positioned chest high on the right side of the T-shirt 1 for a left-handed person.

Figure 2:
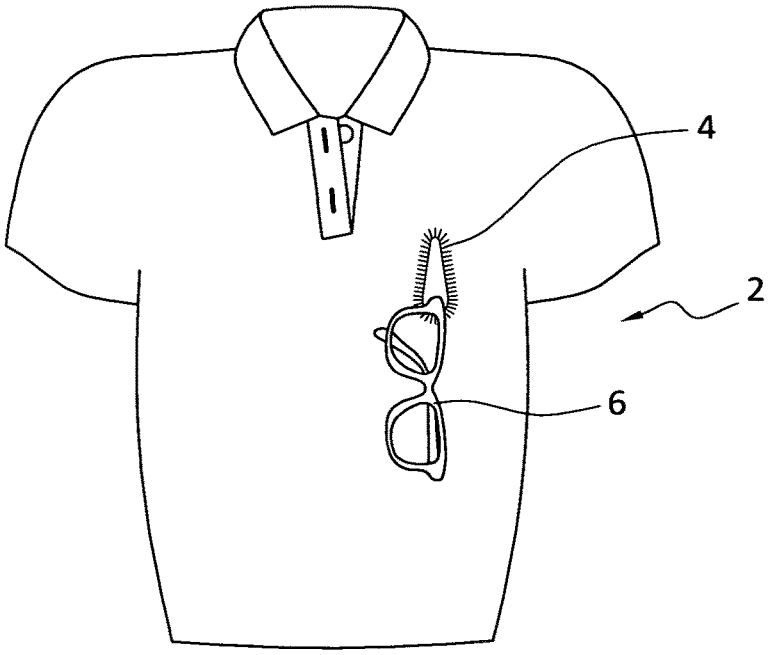
FIG. 2 is a front elevational view of a polo-shirt showing a second embodiment of the invention.

As shown in FIG. 2 the garment eyeglass holder of this invention is also adaptable for a male polo-shirt 2 which method is explained herein below.

As mentioned in the prior Summary of the Invention the garment eyeglass holder is also adaptable for a women T-shirt and polo-shirt.

Figure 3:
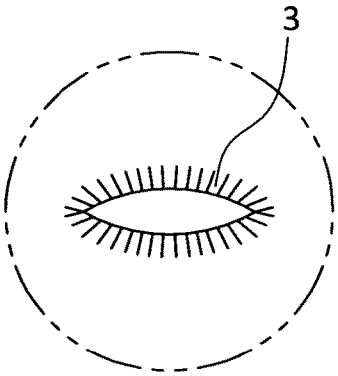
FIG. 3 is an encircled area which shows an exploded view of the threaded, eye-shaped button hole in FIG. 1.
Figure 4:
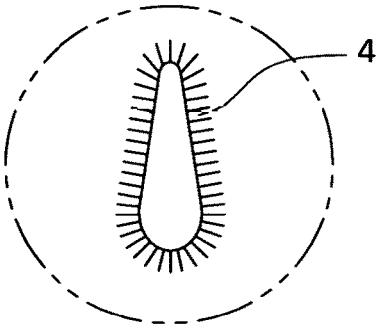
FIG. 4 is an encircled area which shows an exploded view of the threaded, pear-shaped button hole in FIG. 2

The button-hole of the eyeglass holder of this invention can be either eye-shaped as shown in FIG. 3 or pear-shaped as shown in FIG. 4. In the former shape, the threaded, eye-shaped button hole 3 is horizontally positioned on the chest portion of the garment whereas, in the latter shape, the threaded, pear-shaped button hole 4 is vertically positioned with the bulbous end of the threaded, button hole 4 positioned at the lower end of the button hole 4 such that the connection between the inserted temple leg and the eyeglass frame rests in the bulbous end of the button hole 4. The color of the thread used for the button hole is selected to be of a contrasting color visibly different from the color of the garment. For example, if the color of the T-shirt 1 is completely white, which is a conventional color for a T-shirt, then a black thread is used for the threaded button hole 3. If the color of the polo-shirt 2 is completely yellow then a contrasting thread color for the threaded button hole 4 such as brown or black is selected. It is not necessary that the color of the T-shirt or polo-shirt be completely of one color as long as the thread color of the button hole be of a contrasting color visibly different from the color of the chest portion of the garment where the eyeglass holder is to be positioned. The horizontal length of the eye-shaped button hole 3 of this invention is approximately three quarters of an inch and should be loose enough for the easy insertion of a temple leg of a pair of eyeglasses 5. The diameter of the bulbous portion of the threaded, pear-shaped button hole 4 is approximately one half of an inch such that a temple leg of a pair of eyeglasses 6 is readily insertable into the pear-shaped button hole 4. The vertical length of the pear-shaped button hole 4 is approximately three quarters of an inch. The Tex size of the thread selected for the button hole will depend on the fabric weight of the garment which selection will be within the ordinary skill of the workman in the art. For example, for a T-shirt having a fabric weight between 2-4 ounces per square yard, the selection of a thread Tex size of 18 or 24 would be suitable for the button hole thread used for this invention. Although a threaded, pear-shaped button hole 4 is preferred for the polo shirt embodiment a threaded key-shaped button hole would also work in place of the threaded, pear-shaped button hole 4.

Although the eyeglass holder of this invention was described mainly for a pocketless garment such as a T-shirt and a polo-shirt, this invention is also adaptable to other pocketless garments such as sweatshirt, a sport shirt or a sweater.

Modifications of this invention will be readily apparent to those skilled in the clothing art and it is intended that the invention be not limited by the embodiments disclosed herein but that the scope of the invention be defined by the appended claims.

What is claimed is:

1. An eyeglass holder for a garment with a chest portion having a front side with a threaded button hole therein for supporting a pair of eyeglasses wherein said threaded button hole is pear-shaped and oriented vertically on said front side of said chest portion with a bulbous portion of said pear-shaped button hole being at a lowermost position of said pear-shaped button hole and wherein said pair of eyeglasses has a frame with a temple leg at each opposite end of said frame and wherein one of said temple legs is insertable into said bulbous portion of said threaded pear-shaped button hole for retention of said pair of eyeglasses onto to said front side of said chest portion of said garment.

2. The eyeglass holder of claim 1 wherein said garment is made from a preselected material and wherein said pear-shaped threaded button hole is formed of a thread having a size that depends on a fabric weight of said preselected garment material.

3. The eyeglass holder of claim 1 wherein said chest portion of said garment has a predetermined color and wherein the thread used for said pear-shaped button hole is of a contrasting color visibly different from said predetermined color of said chest portion.

4. The eyeglass holder of claim 1 wherein said garment is selected from the group consisting of a T-shirt and a polo-shirt.

5. The eyeglass holder of claim 1 wherein said garment is selected from the group consisting of a sweatshirt, a sport shirt and a sweater.

6. The eyeglass holder of claim 1 wherein the diameter of said bulbous portion of said pear-shaped button hole is approximately ½ inch.

7. An eyeglass holder for a garment with a chest portion having a front side with a threaded button hole therein for supporting a pair of eyeglasses wherein said threaded button hole is key-shaped and oriented vertically on said front side of said chest portion with a larger portion of said key-shaped button hole being at a lowermost position of said key-shaped button hole and wherein said pair of eyeglasses has a frame with a temple leg at each opposite end of said frame and wherein one of said temple legs is insertable into said larger portion of said threaded key-shaped button hole for retention of said pair of eyeglasses onto to said front side of said chest portion of said garment.

8. The eyeglass holder of claim 7 wherein said garment is made from a preselected material and wherein said key-shaped threaded button hole is formed of a thread having a size that depends on a fabric weight of said preselected garment material.

9. The eyeglass holder of claim 7 wherein said chest portion of said garment has a predetermined color and wherein the thread used for said key-shaped button hole is of a contrasting color visibly different from said predetermined color of said chest portion.

10. The eyeglass holder of claim 7 wherein said garment is selected from the group consisting of a T-shirt and a polo-shirt.

11. The eyeglass holder of claim 7 wherein said garment is selected from the group consisting of a sweatshirt, a sport shirt and a sweater.

* * * * *